US005643019A

United States Patent [19]

Barnett et al.

[11] Patent Number: 5,643,019

[45] Date of Patent: Jul. 1, 1997

[54] METHOD AND APPARATUS FOR MONITORING WATER FLOW IN A WATER JET PROPULSION SYSTEM

[76] Inventors: Michael L. Barnett, Rte. #1, Box 3700, Coquille, Oreg. 97423; Larry G. Brader, 538 SW. 283rd St., Federal Way, Wash. 98023

[21] Appl. No.: 558,361

[22] Filed: Nov. 16, 1995

[51] Int. Cl.[6] ..... B63H 11/02

[52] U.S. Cl. ..... 440/2; 440/38; 440/47

[58] Field of Search ..... 440/1, 2, 46, 47, 440/38; 239/71; 340/606–611

[56] References Cited

U.S. PATENT DOCUMENTS

| | | | |
|---|---|---|---|
| 3,793,997 | 2/1974 | Banner | 123/41.15 |
| 4,100,877 | 7/1978 | Scott et al. | 440/1 |
| 4,485,794 | 12/1984 | Kimberley et al. | 123/569 |
| 4,530,463 | 7/1985 | Hiniker et al. | 239/71 |
| 4,630,036 | 12/1986 | Ford | 340/622 |
| 4,821,568 | 4/1989 | Kiske | 340/606 |
| 4,887,068 | 12/1989 | Umehara | 340/450.3 |
| 4,934,970 | 6/1990 | Lamprey | 440/2 |
| 5,004,439 | 4/1991 | Onoue | 440/2 |
| 5,007,286 | 4/1991 | Malcolm et al. | 73/181 |
| 5,016,006 | 5/1991 | Umehara | 340/984 |
| 5,244,425 | 9/1993 | Tasaki et al. | 440/38 |
| 5,330,376 | 7/1994 | Okumura | 440/88 |

*Primary Examiner*—Sherman Basinger
*Attorney, Agent, or Firm*—Stratton Ballew

[57] ABSTRACT

A new method and apparatus for monitoring propulsion water flow in a water jet propulsion system that distinguishes propulsion system impairment from other potential causes of marine engine over-revving, allowing the accurate assessment of propulsion system function from a remote location, such as the vessel's instrument panel. This monitoring also prevents engine power loss, damage or failure and provides for the accurate assessment of propulsion system function from a remote location minimizing dangers arising from unmanned vessel operation and direct inspection of equipment. This marine propulsion system monitoring method and device, and a water craft pumping system monitoring method and device can both be monitored with the same display equipment, saving on the space and expense of two displays, one for each monitored system.

8 Claims, 13 Drawing Sheets

METHOD AND APPARATUS FOR MONITORING WATER FLOW IN A WATER JET PROPULSION SYSTEM

TECHNICAL FIELD

The invention relates to a method and apparatus for monitoring the functional status of a water jet propulsion system for water craft. Specifically, the invention relates to a method and apparatus for monitoring propulsion water flow in a water jet propulsion system, to determine the functional status of a water jet propulsion system.

BACKGROUND OF THE INVENTION

Water jet propulsion systems are becoming increasingly popular. Many skiers, fishers and family boaters realize that water jet propelled craft offer safety, simplicity and diverse utility. The propulsive force of the water jet transfers directly into the water without going through gears, right-angle shafts, or clutches. This translates into less weight, lower cost, lower maintenance and more reliability when compared to standard marine propeller drives.

Functionally, a water jet propulsion system, or marine jet drive, is simply a propeller inside a pipe. The propeller operates as a pump impeller or rotor. The propulsion water intake port is typically an opening near the bottom of the hull, which picks up water and delivers it to the jet pump impeller. A grill across the intake port prevents foreign matter from entering the system. Water jet propulsion systems are also available in outboard engine packages for water craft. Simply stated, all marine jet drives function by inhaling water, compressing it, and passing it out a nozzle in the stern. The result is a powerful jet of water that pushes the vessel forward in the water.

A water jet propulsion system can operate in just inches of water, as there is no external propeller. Jet driven water craft can skim flats, thread treacherous rocky passages and navigate river shoals. However, running these craft in extremely shallow water can disturb the bottom environment, clogging the jet with sand, gravel, weeds, litter or any other material bypassing the propulsion water intake grill.

A variety of problems result when the propulsion water intake becomes clogged. When the obstruction is only partial, the operator may notice a slight loss of power. If the cause of the reduced power is misinterpreted, the operator may compensate by increasing the fuel feed to the jet drive engine. The engine responds to the increase in fuel by increasing its revolutions per minute (R.P.M.). At a minimum, partial blockage of the propulsion water intake results in poor fuel economy and unnecessary wear on the engine from the over-revving. Serious engine damage occurs from prolonged or severe over-revving.

A fully blocked propulsion water intake generally results in cavitation, or boiling of the propulsion water. Cavitation is produced by near-vacuum suction around the impeller. The resultant vapor bubbles in the water reduce the load on the engine, so that it over-revs. Additionally, because of the increase in suction caused by the blockage, the material clogging the propulsion water intake can be drawn into the jet impeller, resulting in possible permanent damage to the impeller. Such damage may require underwater repairs, which are difficult and costly. Even brief failure of propulsion water flow can cause over-revving, which ultimately results in engine damage or failure.

In rough or "choppy" water there is an immediate "blowout," or loss of power, when the jet drive comes out of the water. The operator of a jet drive water craft must be able to quickly diagnose the cause of the power loss, as swift corrective measures may be essential to safe docking or maneuvering.

The occasional failure of propulsion water flow is nearly impossible to avoid. This is especially true because most marine jet propulsion systems rely on sea or take water, drawn into the system via the propulsion water intake. Although this design provides an unlimited supply of propulsion water, there is a significant chance that waterborne debris, seaweed, dirt or dissolved minerals will cause problems in these water jet propulsion systems. Such water borne materials can clog or foul the propulsion water intake, the propulsion pipe or the outlet nozzle. Damage to the impeller is also likely, leading to propulsion system failure.

It is known to monitor marine engine over-revving using R.P.M. indicators. However, such indicators do not discern whether the over-revving is due to propulsion system failure, or is attributable to another cause, such as decreased engine load. Consequently, troubleshooting is more complicated and time consuming, and can result in unnecessary alarm over innocuous over-revving events, or inattention to serious over-revving problems.

Also, reliance on the engine R.P.M. indicator is unwise because engine damage can occur so rapidly after propulsion failure that engine sensors may not register the problem until it is too late to avoid engine damage.

The poor reliability of engine R.P.M. indicators for monitoring marine propulsion system function is widely recognized. To overcome this problem, most marine engine operators currently monitor their propulsion system's function directly, by visually inspecting the output of propulsion water from the jet drive. In a boat, this typically requires that the operator leave the helm, walk to the stern of the vessel, and peer over the rail to view the water stream. On a jet ski, the operator must turn around, while the jet ski is in motion, to observe the water stream. These actions result in obvious personal and traffic safety hazards. Furthermore, the propulsion water stream is often not observable due to rough waters, darkness, or physical obstructions such as a stern mounted swim step. Also, the inspection may be omitted due to operator inadvertence or activity conflicts. Finally, visual inspections of propulsion system function are by nature highly subjective and prone to inaccuracy. Low to intermediate propulsion water flow levels may be interpreted by an inexperienced water craft operator as adequate, although such levels may reflect critical impairment of the propulsion system.

Preventive maintenance is currently the only reliable means to insure the impeller or pump remains functionally intact. Impellers, rotors and propellers are periodically replaced at considerable expense for fear that they may soon fail.

A need exists for the monitoring of the long term performance of the water jet propulsion system by measuring the water outflow flow rate. Small changes in flow rate suggest the need for inspection or replacement. If a reliable assessment of the water jet propulsion system integrity was available, then the water craft operator could accurately determine the functional efficiency of the water jet propulsion system during normal operations. With this information, a water craft operator could safely approach, or even exceed, the advertised service life of the impeller, as long as it still functioned at an acceptable level of efficiency.

A further need exists for the monitoring of the propulsion water flow rate from a water jet propulsion system. The decrease over time of the rate of water propelled through the jet at a constant engine load can suggest a developing problem with the jet propulsion system. The verification of uninterrupted flow of propulsion water through a water jet propulsion system is essential to its optimal operation.

A related need exists for a method and apparatus for monitoring a water jet propulsion system function that distinguishes propulsion system impairment from other potential causes of marine engine over-revving.

A need also exists for a method and apparatus for monitoring water jet propulsion system function that employs direct monitoring of propulsion water flow through the water jet propulsion system.

A further need exists for the monitoring of the long term performance of the impeller or rotor for the water jet propulsion system. Small changes in flow rate suggest the need for inspection or replacement, and under normal operation, the service life of the impeller could be safely approached or exceeded if a reliable assessment of impeller integrity was available.

SUMMARY OF INVENTION

According to the present invention, a water jet propulsion system is monitored using a method and apparatus that distinguish propulsion system impairment from other potential causes of marine engine over-revving, by monitoring propulsion water flow.

According to one aspect of the invention, the monitoring of propulsion system function is achieved by monitoring propulsion water flow through the propulsion system.

According to another aspect of the invention, a water jet propulsion system monitoring method and device allows accurate assessment of propulsion system function from a remote location, such as the vessel's instrument panel.

According to another aspect of the invention, a marine propulsion system monitoring method and device, and a water craft pumping system monitoring method and device are both monitored with the same display equipment.

The invention provide a method and apparatus for remotely monitoring the functional status of a water jet propulsion system. The method of the invention includes an initial step of sensing whether a flow of propulsion water is present or absent in an intake pipe of a marine engine, to establish a sensed flow status of the propulsion system. Following the sensing step, a transducible, first flow status signal reflective of the sensed flow status of the propulsion system is provided. The first signal is then transduced to provide a second signal relational with respect to the first signal. Lastly, the second signal is translated to provide a third, operator-detectable, flow status signal, from which a human operator can remotely monitor the functional status of the propulsion system. It is a further object of the invention to achieve the above objects in a marine propulsion system monitoring method and apparatus that provide for timely detection and notification of propulsion system impairment. Thereby allowing a water craft operator to take corrective action against marine engine over-revving due to water jet propulsion system impairment before engine damage or failure occurs.

In a preferred method of the invention, the flow rate of propulsion water in the intake pipe is sensed to establish a sensed propulsion water flow rate, to more accurately sense the functional status of the propulsion system. The sensed flow rate is reflected in a transducible, first flow rate signal, which is transduced to provide a second signal, proportionally variable with respect to the first signal. The second signal is translated to provide a third, operator-detectable, flow rate signal from which a human operator can remotely monitor the propulsion water flow rate in the propulsion system.

In a preferred embodiment of this invention a sensor is installed to sense the propulsion water flow rate in a jet propulsion water intake pipe. A transducer then converts the sensed propulsion water flow rate to a proportionally variable signal. The proportionally variable signal is then input to a visual display for an instantaneous indication of propulsion water flow. With this information visually displayed in a convenient and easy to interpret manner the water jet propulsion system operator has the opportunity to take corrective action before engine damage resulting from a propulsion water system malfunction.

In another preferred embodiment of the invention, the transduced variable signal is amplified and processed into a time averaged signal with specific sensed propulsion water flow rates corresponding to specific scaled signal values to provide translated time averaged signals. The time averaged signal is then input to a visual display, typically a digital display device, for an instantaneous indication of propulsion water flow.

In yet another preferred embodiment of the invention, the visual display is a combined visual display device for the water jet propulsion system and additional pumping systems present on a water craft, and is equipped with a processing display driver.

According to one advantage of the invention, timely detection and notification of propulsion system impairment is achieved, allowing a water craft operator to take corrective action against marine engine over-revving before engine damage or failure occurs. This monitoring also prevents engine power loss.

According to another advantage of the invention, the accurate assessment of propulsion system function from a remote location minimizes dangers arising from unmanned vessel operation and direct inspection of equipment.

According to yet another advantage of the invention, a marine propulsion system monitoring method and device, and a water craft pumping system monitoring method and device, when both monitored with the same display equipment, save on the space and expense of two displays, one for each monitored system.

BRIEF DESCRIPTION OF DRAWINGS

FIG. 3 shows the interrelationship of partial views of FIGS. 3A and 3B.

FIG. 4 shows the interrelationship of partial views of FIG. 4A, FIG. 4B and FIG. 4C.

FIG. 5. shows the interrelationship of partial views of FIG. 5A, FIG. 5B and FIG. 5C.

FIG. 6 shows the interrelationship of partial views of FIG. 6A, FIG. 6B and FIG. 6C.

DETAILED DESCRIPTION OF SPECIFIC EMBODIMENTS

Figure 1:
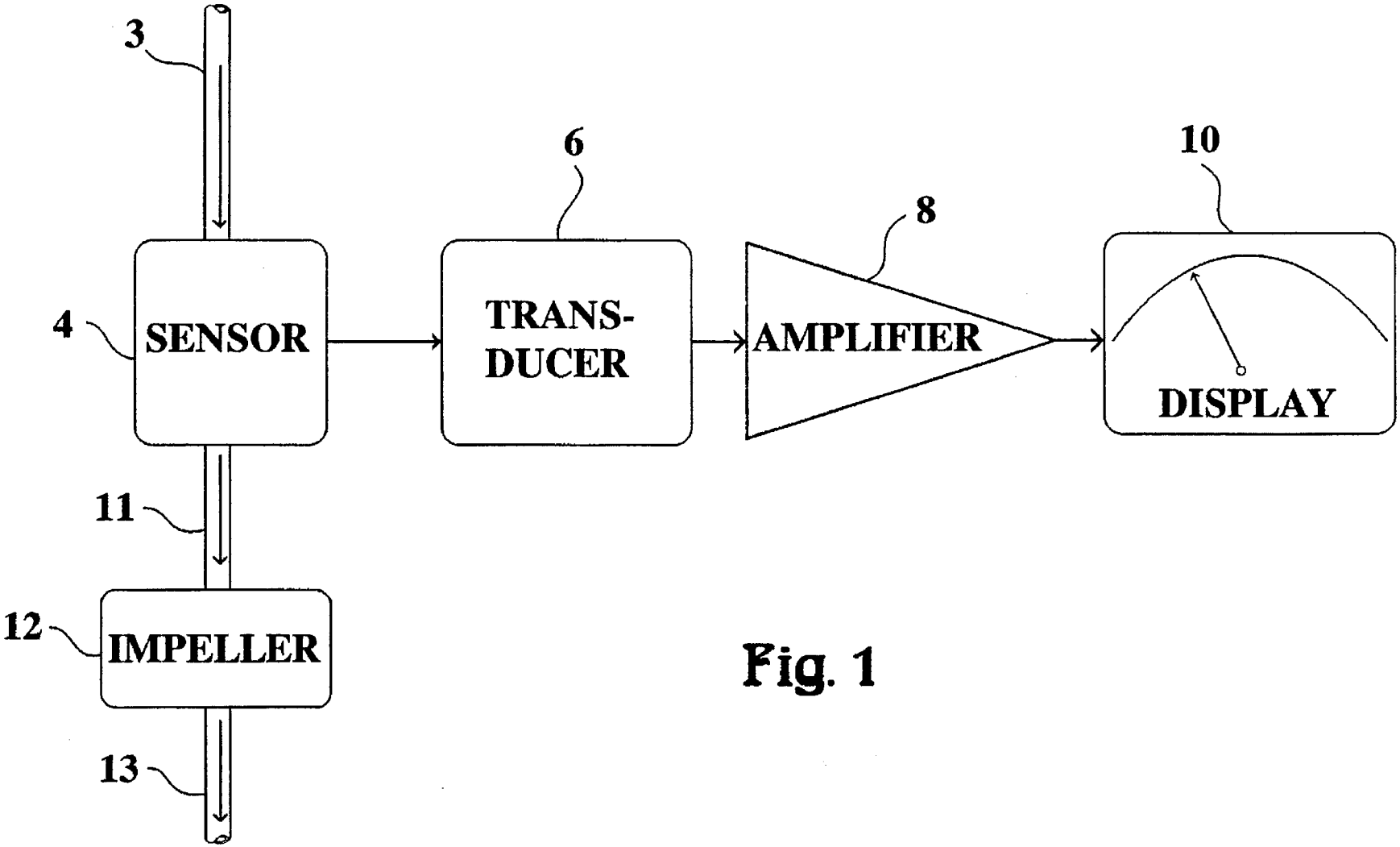
FIG. 1 is a notated schematic diagram of an apparatus for remotely monitoring marine engine propulsion water flow, employing the concepts of the present invention.

The invention provides a method for remotely monitoring the functional status of a water jet propulsion system. A notated schematic diagram of the portion of the invention providing a method for remotely monitoring the functional status of a water jet propulsion system is shown in FIG. 1. A flow of propulsion water in a water jet intake pipe 3 is sensed by a flow sensor 4. The sensed propulsion water flow rate provided by the flow sensor is converted into a second signal by a transducer 6. An amplifier 8 is used to amplify the second signal from the transducer. The second signal from the amplifier, now amplified, is input to visual display 10, displaying the instantaneous rate of propulsion water flow.

Figure 2:
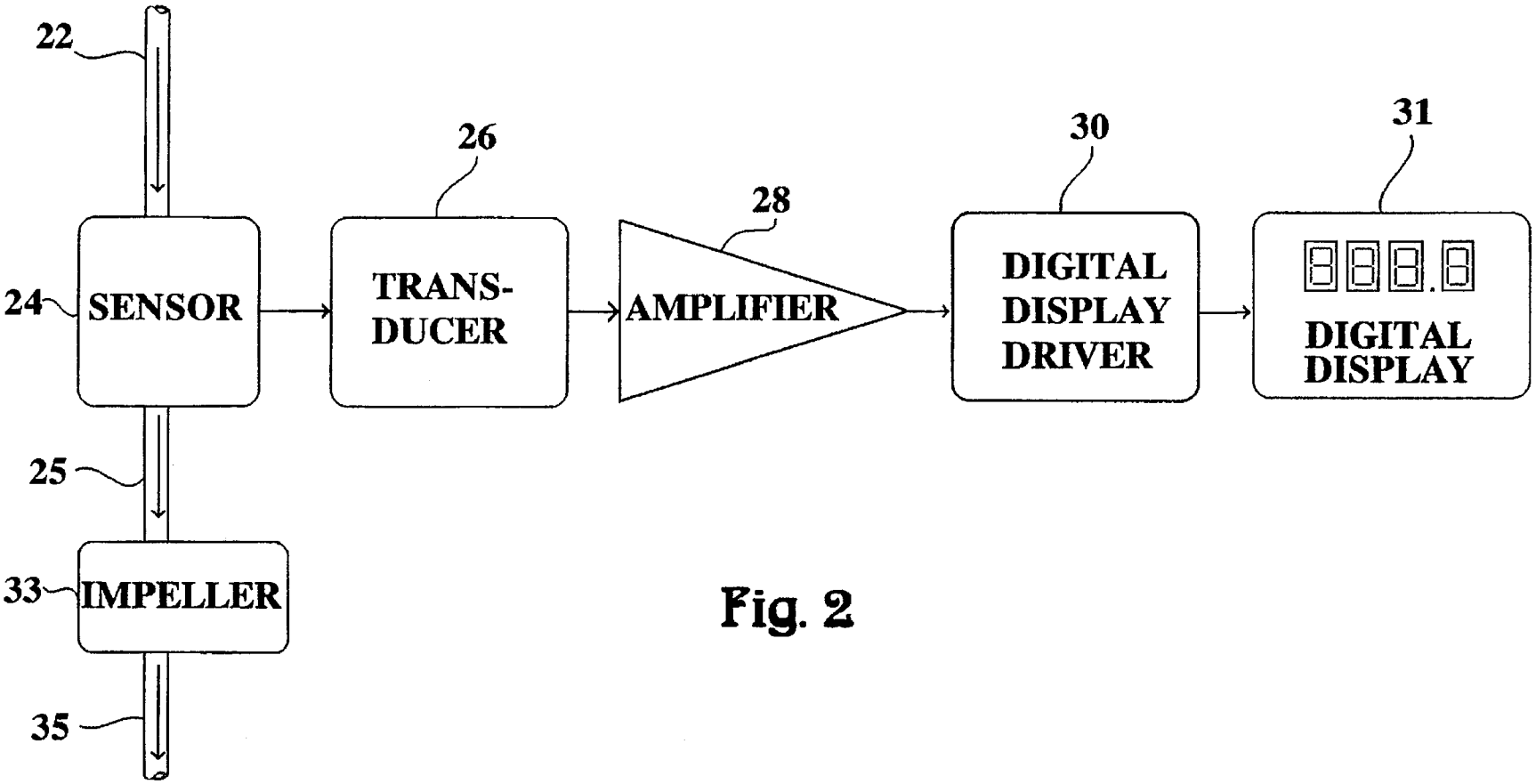
FIG. 2 is a notated schematic diagram of an apparatus for remotely monitoring marine engine propulsion water flow including a digital electronic display mechanism employing the concepts of the present invention.

An alternative embodiment is notated in the schematic diagram shown in FIG. 2. A flow of propulsion water in a water jet propulsion water intake pipe 22 is sensed by a flow sensor 24. The sensed propulsion water flow rate provided by the sensor is converted into a proportionally variable signal by a transducer 26. An amplifier 28 is used to amplify the proportionally variable signal from the transducer means. The amplified signal from the amplifier is input to a digital display driver 30. The output from the digital display driver is input to a digital visual display 31. The visual display is typically an electronic digital display device or an electromechanical pointer.

Figure 3A:
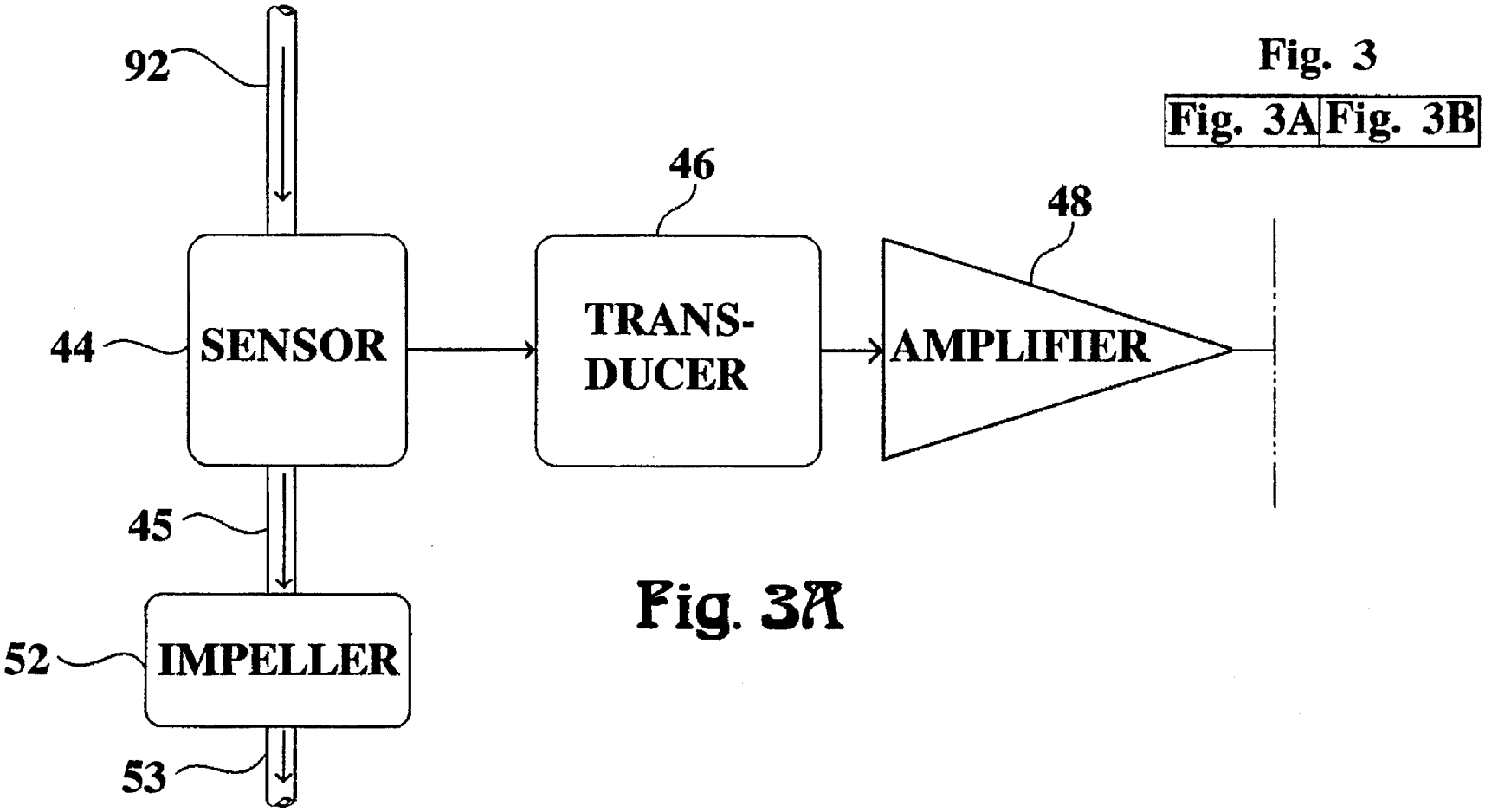
FIGS. 3A and 3B are notated schematic diagrams of an apparatus for remotely monitoring marine engine propulsion water flow including a signal processing unit and a digital electronic display mechanism, employing the concepts of the present invention.
Figure 3B:
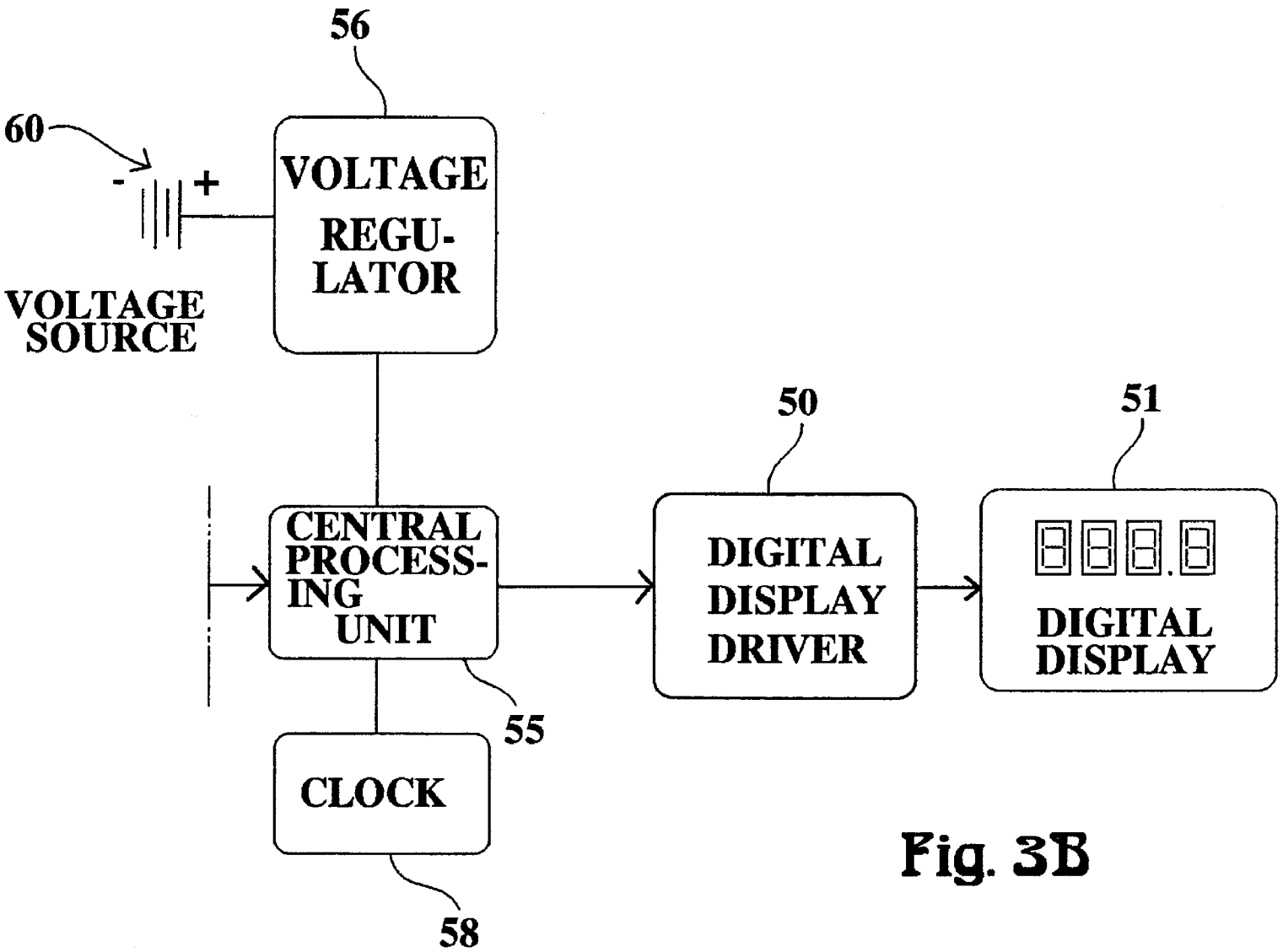

Another embodiment is notated in schematic diagram FIG. 3. A flow of propulsion water in a water jet intake pipe 42 is sensed by a flow sensor 44. The sensing sensed propulsion water flow is converted into a proportionally variable signal by a transducer 46. An amplifier 48 is used to amplify the proportionally variable signal from the transducer. The amplified signal from the amplifier is input to a processor 55. The processor translates input into time averaged signal with specific sensed propulsion water flow rates relating to specific scaled signal values. Time averaging translation is helpful to reduce the fluctuations observed in an instantaneous reading of propulsion water flow.

The processor 55 relies upon a low signal regulator 56 for a constant low signal supply and a clock 58 to provide base timing for rate averaging over time. The processor supplies input for display driver 50. The display driver converts input for the visual display 51. The visual display is typically situated in the instrument panel or another position readily observable by the vessel operator.

The visual display 51 is typically an electronic digital display device or an electromechanical pointer, with a light or an audible alarm for low or zero propulsion water flow rate readings.

Figure 4A:
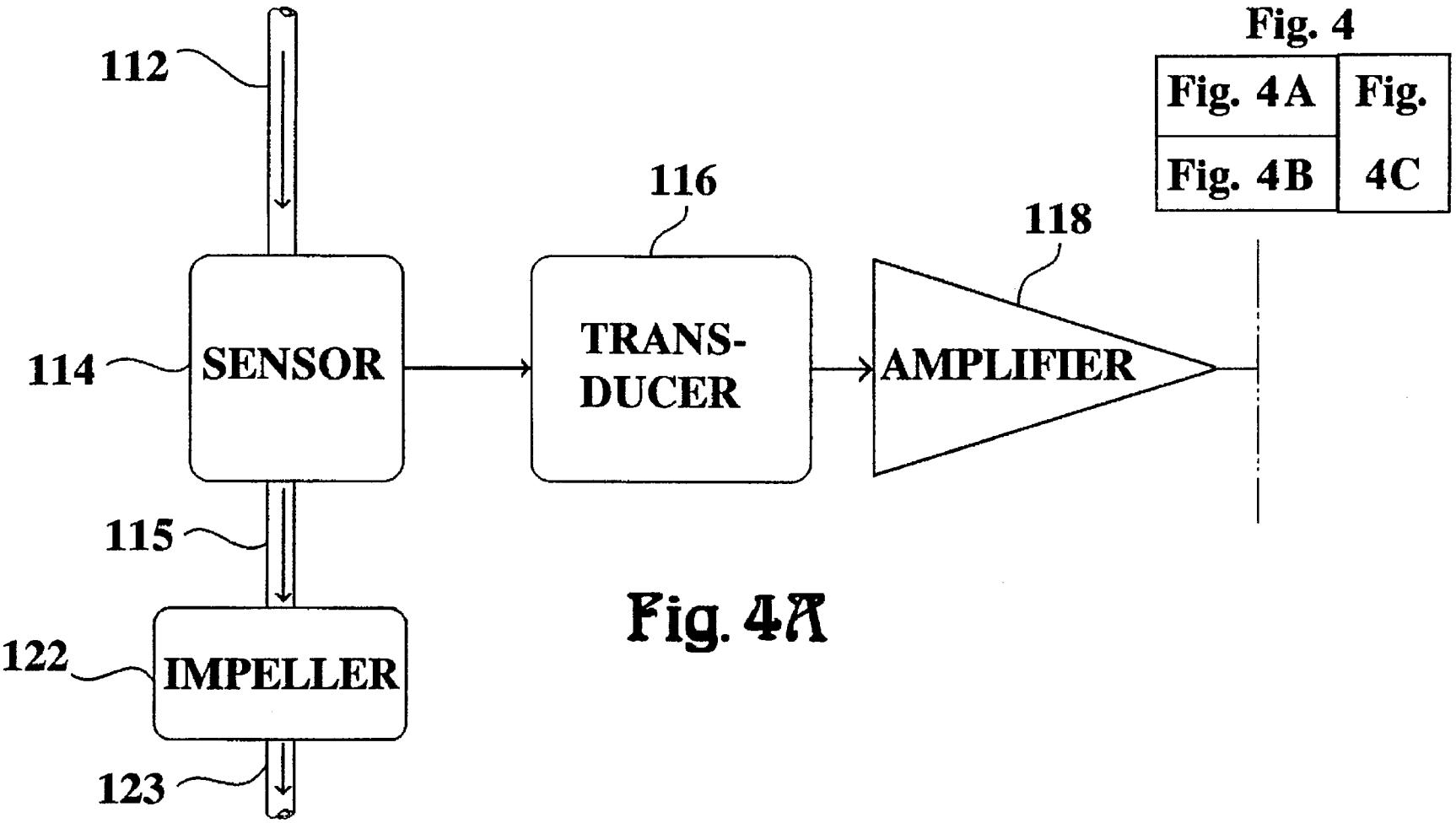
FIGS. 4A, 4B, and 4C are notated schematic diagrams of an apparatus for remotely monitoring marine engine propulsion water flow combined with an apparatus for remotely monitoring water flow in a water pumping system present on a water craft, employing the concepts of the present invention.
Figure 4B:
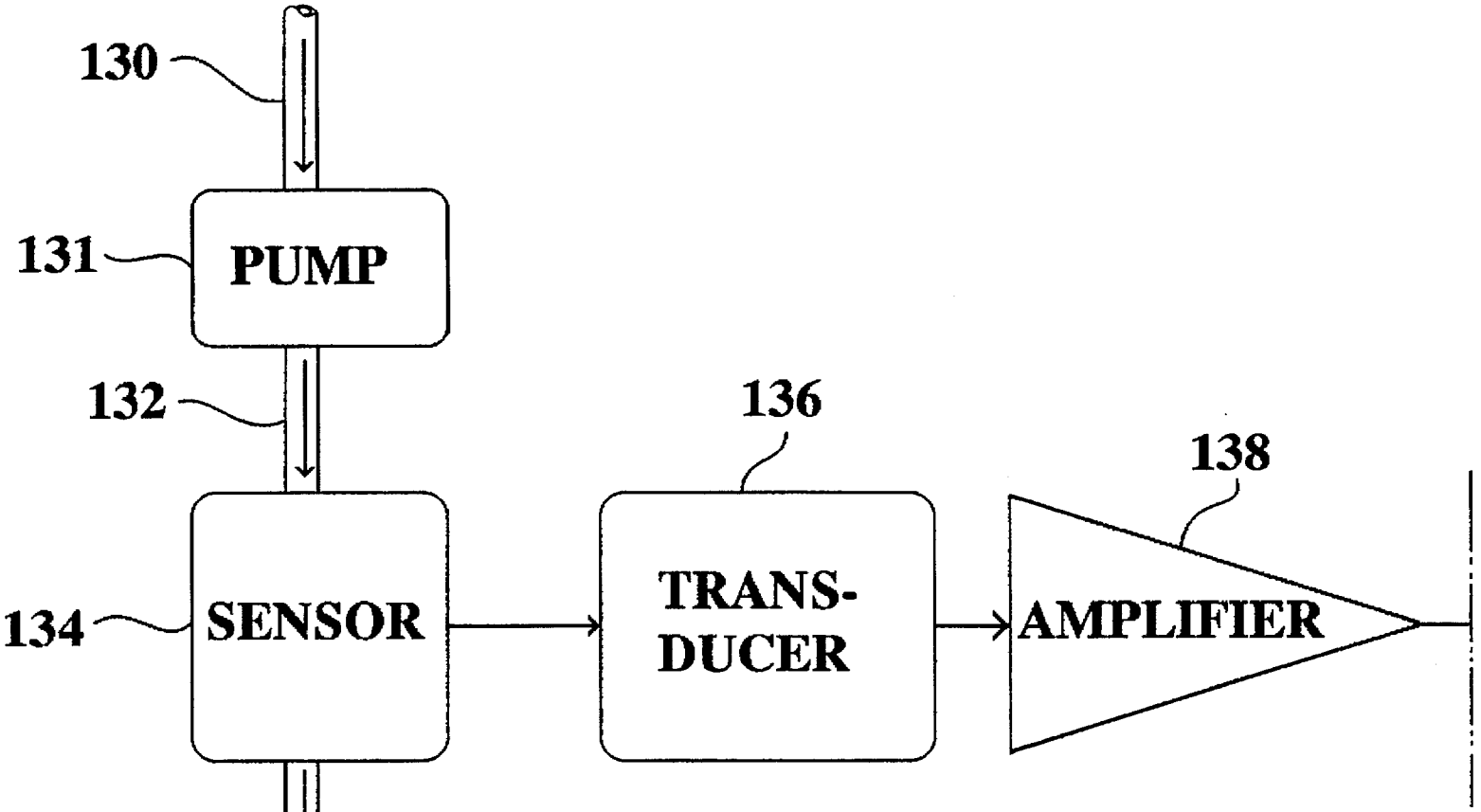
Figure 4C:
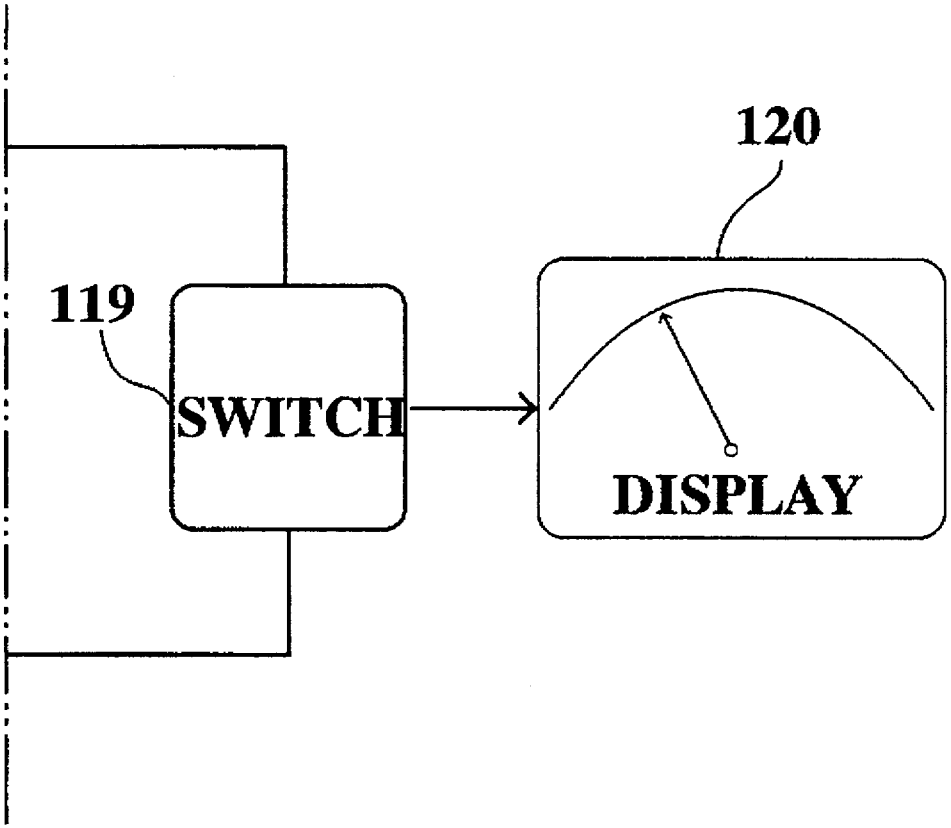

A notated schematic diagram of the invention for remotely monitoring the functional status of a water jet propulsion system and the functional status of additional water pumping systems present on a marine craft is shown in FIG. 4. A flow of propulsion water in a water jet intake pipe 112 is sensed by a flow sensor 114. The sensed propulsion water flow rate provided by the flow sensor is converted into a second signal by a transducer 116. An amplifier 118 is used to amplify the second signal from the transducer. An amplified signal from the amplifier is input to a visual display 120, through switch 119, thereby displaying the instantaneous rate of engine propulsion water flow. The visual display is typically an electronic digital display device or an electromechanical pointer.

Switch 119 enables the operator to manually alternate input to the visual display 120, between propulsion water flow monitoring and other pump flow monitoring. With this information, visually displayed in a convenient and easy to interpret manner, the vessel operator has the opportunity to take corrective action before additional engine and vessel damage resulting from either a propulsion water system malfunction or a pumping system malfunction.

Figure 5A:
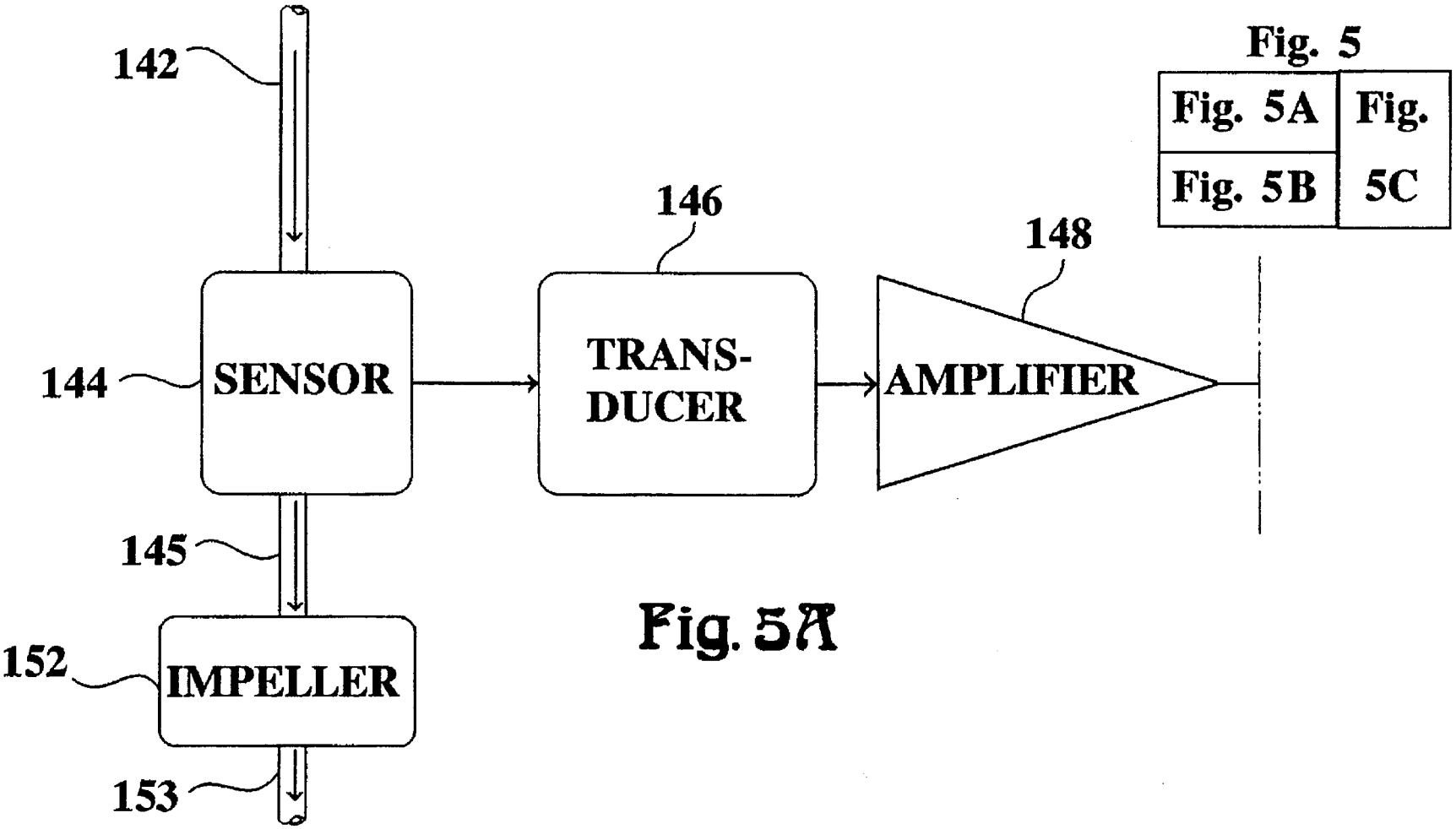
FIGS. 5A, 5B, and 5C are notated schematic diagrams of the apparatus for remotely monitoring marine engine propulsion water flow and a water craft pumping system, also including a digital electronic display mechanism, employing the concepts of the present invention.
Figure 5B:
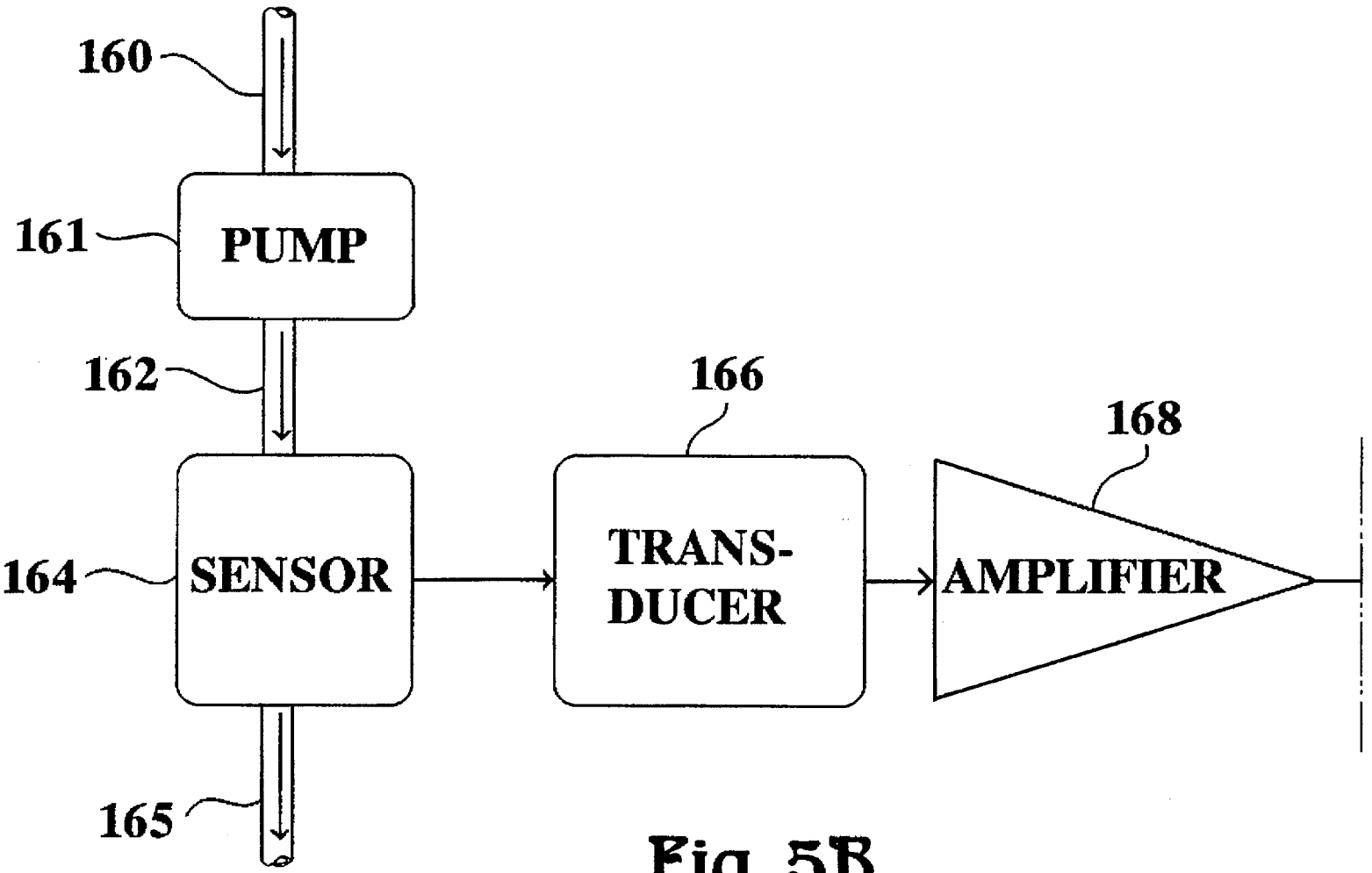
Figure 5C:
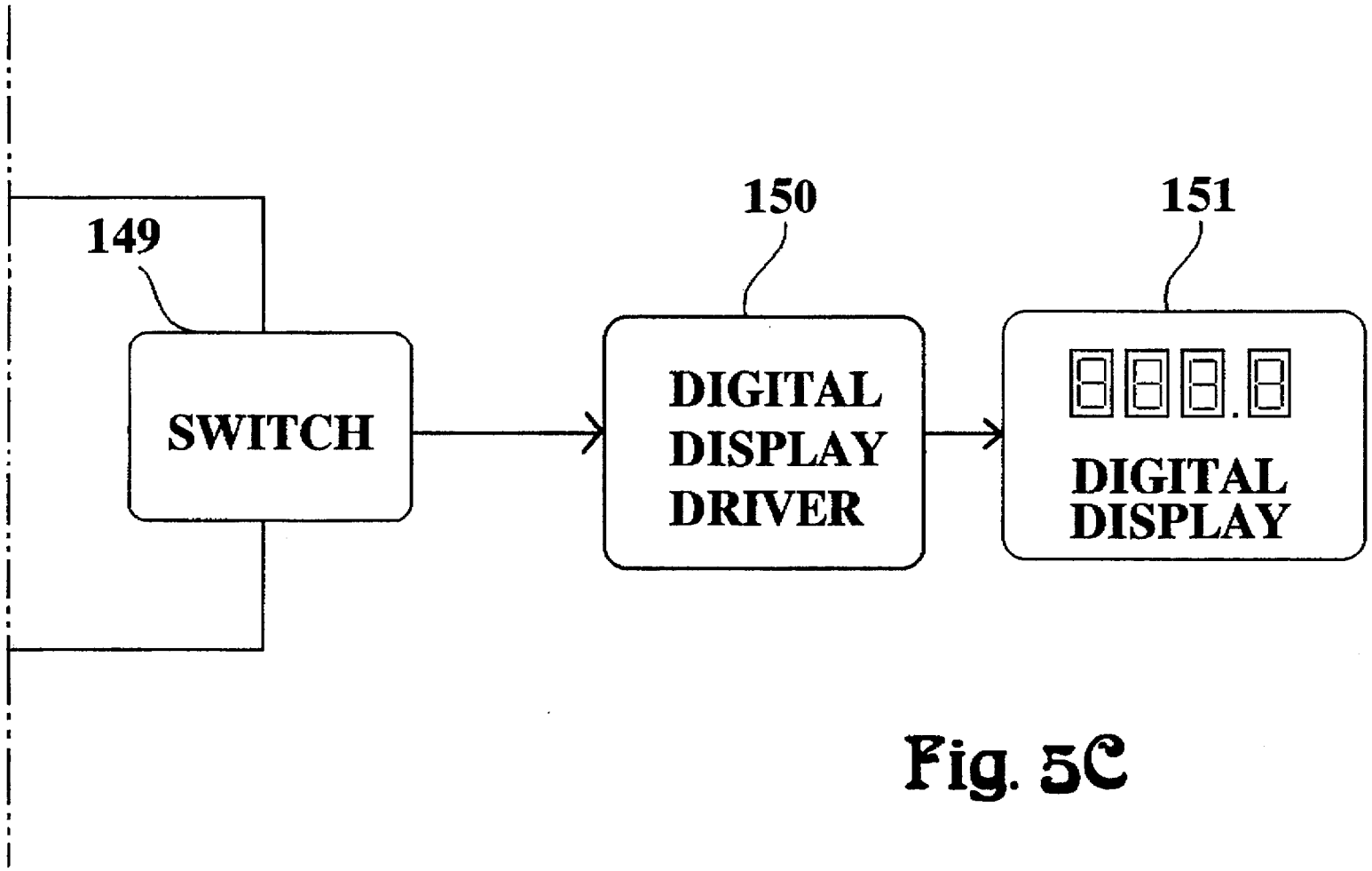

An alterative embodiment is notated in the schematic diagram shown in FIG. 5. A flow of propulsion water in a propulsion water intake pipe 142 is sensed by a flow sensor 144. The sensor sensed propulsion water flow is converted into a proportionally variable signal by a transducer 146. An amplifier 148 is used to amplify the proportionally variable signal from the transducer. An amplifier 148 is used to amplify the proportionally variable signal from the transducer. An amplified signal from the amplifier is input to a digital display driver 150, through switch 149. The output from the digital display driver is input to a digital visual display 151. The visual display is typically an electronic digital display device or an electromechanical pointer. The visual display is typically situated in the instrument panel or another position readily observable by the vessel operator. The visual display 151 is typically an electronic digital display device or an electromechanical pointer, with a light or an audible alarm for low or zero coolant water flow rate readings.

Switch 119 enables the operator to manually alternate input to the digital display driver 150, and then to the digital visual display 151, between propulsion water flow monitoring and other pump flow monitoring.

Figure 6A:
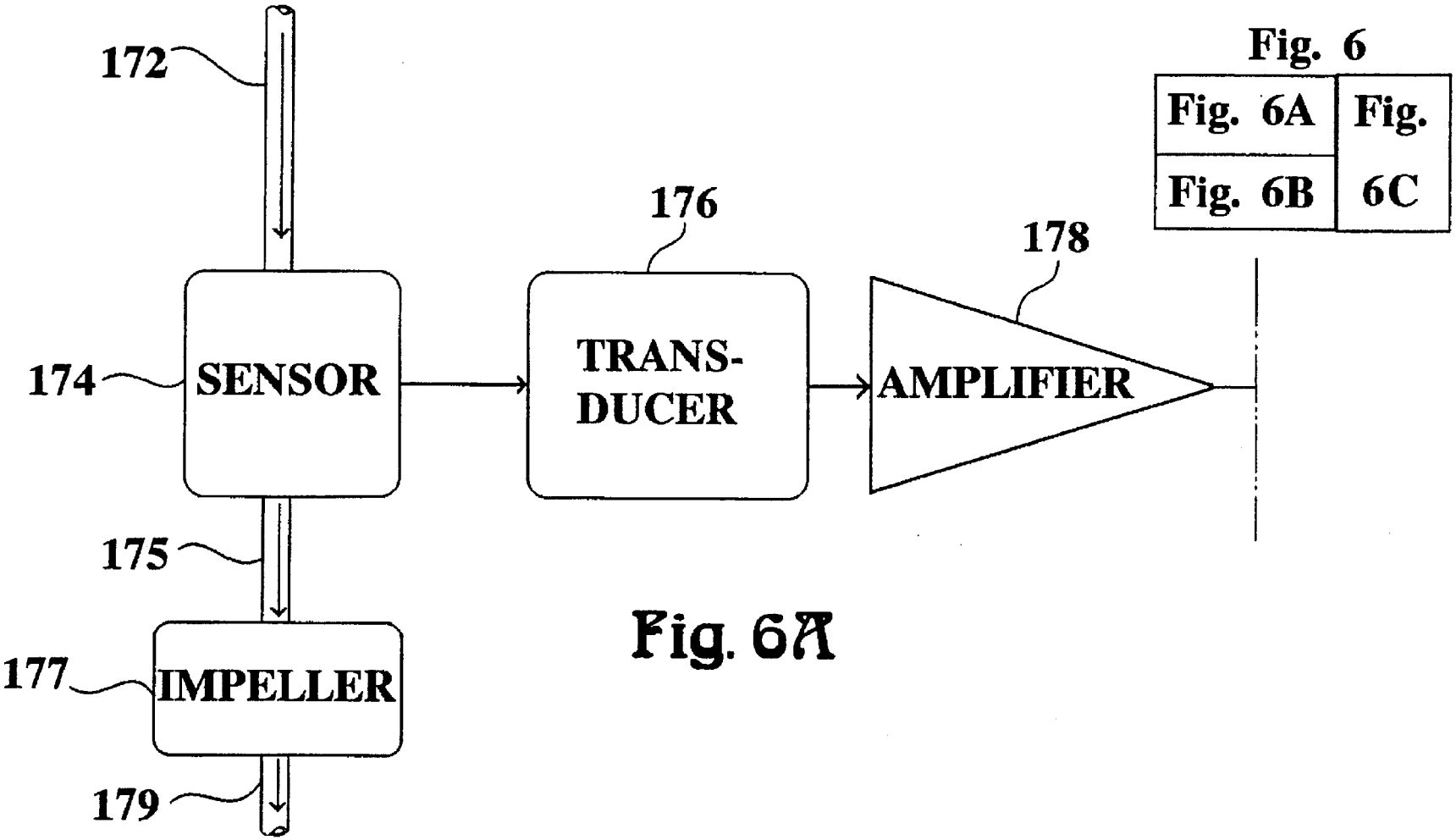
FIGS. 6A, 6B, and 6C are notated schematic diagrams of an apparatus for remotely monitoring marine engine propulsion water flow and a water craft pumping system, also including a signal processing unit and a digital electronic display mechanism, employing the concepts of the present invention.
Figure 6B:
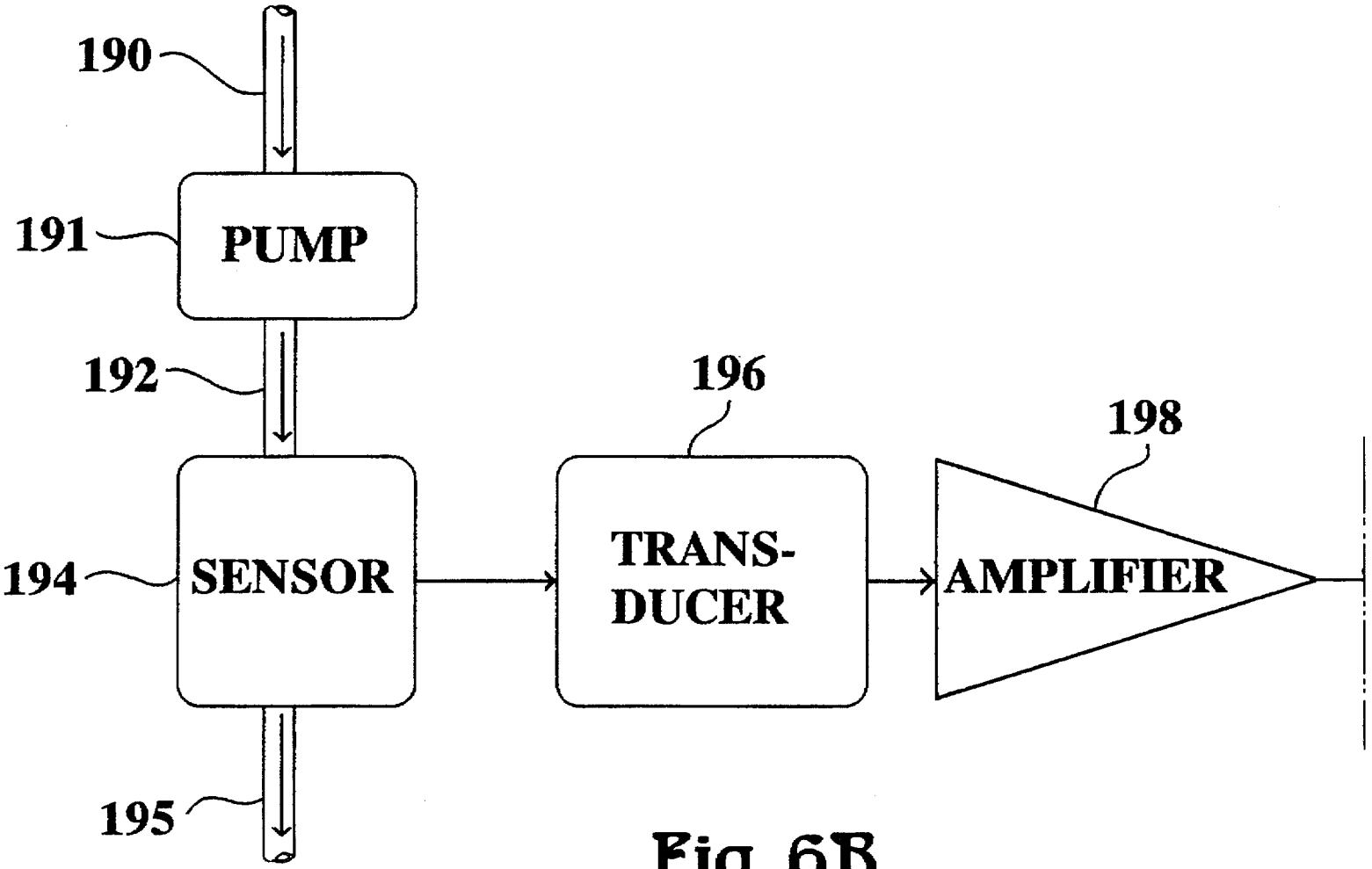
Figure 6C:
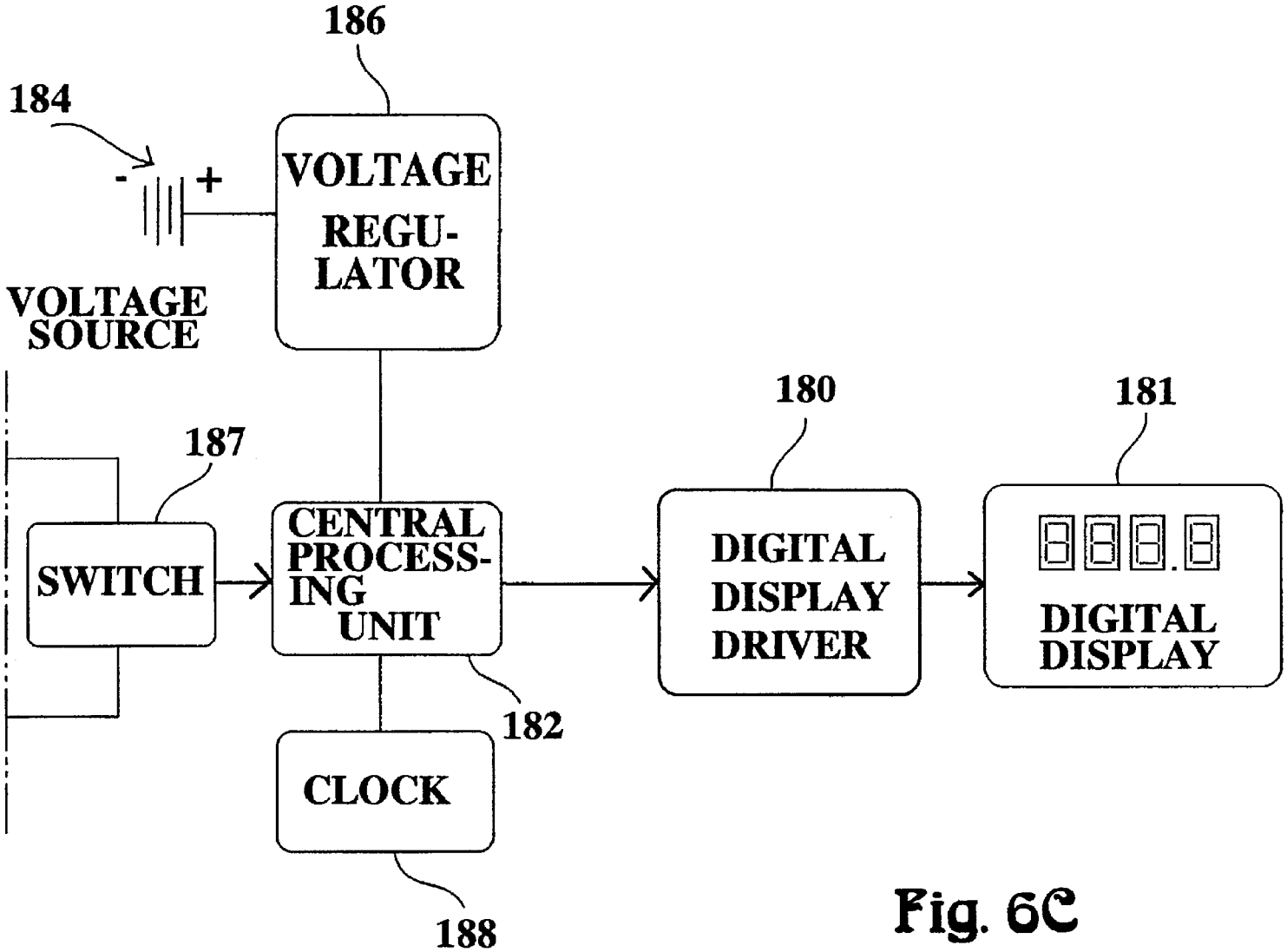

Another embodiment is notated in schematic diagram FIG. 6. A flow of propulsion water in a water jet intake pipe 172 is sensed by a flow sensor 174. The sensor sensed propulsion water flow is converted into a proportionally variable signal by a transducer 176. An amplifier 178 is used to amplify the proportionally variable signal from the transducer. The amplified signal from the amplifier is input to a processor 182. The processor translates input into a time averaged signal with specific sensed propulsion water flow rates relating to specific scaled signal values. Time averaging translation is helpful to reduce the fluctuations observed in an instantaneous reading of propulsion water flow.

The processor 182 relies upon a low signal regulator 186 for a constant low signal supply and a clock 188 to provide base timing for rate averaging over time. The processor supplies input for display driver 180. The display driver converts input for the visual display 181. The visual display is typically situated in the instrument panel or another position readily observable by the vessel operator.

The visual display 181 is typically an electronic digital display device or an electromechanical pointer, with a light or an audible alarm for low or zero coolant water flow rate readings.

Switch 187 enables the operator to manually alternate input to the digital display driver 180, and so to the digital visual display 181. The operator is thus able to alternatively monitor propulsion water flow or additional water pumping systems present on a marine craft.

In an embodiment of the invention, a vessel is retrofitted with the equipment required to achieve an instrument panel indication of proper propulsion water and additional water pumping systems present on a marine craft. The transducer 176 or 196 is combined with the sensor 174 or 194 in an Omega Engineering brand flow sensor, model numbers FPSS5100 or FPS5300, which produce a proportionally variable signal that is a proportionally variable electrical frequency. The amplifier 178 or 198 is an 0P AMP model numbers LM301 or LM741. The processor 182 is an Intel 8051 chip. The voltage regulation 186 is a Fairchild 7805. The clock 188 is a Mouser model number 332–5120. The display driver 180 is a General Instrument model number MAN3810. The display 181 is an Industrial Electronic Engineer, Inc., model number LR37784R.

Alternatively, the sensor may be any appropriate sensing means. Any flowmeter that can sense liquid flow within a pipe in a marine environment may be selected as a combination of the sensor 174 or 194 and transducer 176 or 196.

Also alternatively, the transducer may be any available transducing means that will support the sensor selected. Since electrical connections easily corrode in marine environments, alternatives such as pneumatic pressure or fiber optics are contemplated. Likewise, the processor may be any appropriate processing means.

Also, alternatively, display. Water nical pointer can be used instead of a digital display. Water craft operators often find an analog gauge preferable to a digital readout.

Also alternatively, the visual display's of propulsion system flow and the flow in additional water pumping system can be combined in one unit with the necessary switches to alternate the system and specific monitored qualities desired for observation. This enables the comparison of these critical and quite possibly interrelated water pumping systems on board a vessel. For example, a failure of the propulsion water system may result in an increase in bilge water pumping due to an internal rupture in the propulsion water system. This type of failure would be observable in a combined remote display, but otherwise not perceived unless by direct observation of the propulsion system leak or further failures resulting from the leaking propulsion water.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible which employ the same inventive concepts as described above. Therefore, the invention is not to be limited except by the claims that follow.

What is claimed is:

1. A method for remotely and instantaneously monitoring a propulsion water flow rate in a water jet propulsion system comprising the steps of:

a) sensing an instantaneously variable propulsion water flow rate using a flow sensor located in a propulsion water intake pipe;

b) providing a first signal to establish an instantaneously sensed propulsion water flow rate;

c) transducing the first signal to provide a second flow rate signal proportionally variable in relation to the first signal; and d) translating the second flow rate signal to provide a third flow rate signal, proportionally variable in relation to the first signal to provide an instantaneous indication of the instantaneously variable propulsion water flow rate, whereby an operator of the water jet propulsion system can monitor the third flow rate signal and thereby remotely instantaneously monitor the propulsion water flow rate in the water jet propulsion system.

2. The method of claim 1, including the step of processing the second flow rate signal before the translating step to yield a time averaged second signal, having signal levels proportionally variable in relation to specific time averaged sensed propulsion water flow rates.

3. An apparatus for remotely and instantaneously monitoring a propulsion water flow rate in a marine water jet propulsion system comprising:

a) a flow sensor located in a propulsion water intake pipe for sensing an instantaneously variable propulsion water flow rate in the propulsion water intake pipe;

b) means for generating a first signal to establish an instantaneously sensed propulsion water flow rate;

c) transducing means for transducing the first signal to provide a second flow rate signal proportionally variable in relation to the first signal; and d) translation means for translating the second flow rate signal to provide a third flow rate signal, proportionally variable in relation to the first signal, to provide an instantaneous indication of the instantaneously variable rate of flow, whereby an operator of the water jet propulsion system can monitor the third flow rate signal and thereby remotely instantaneously monitor the propulsion water flow rate in the water jet propulsion system.

4. The apparatus of claim 3, further comprising a processing means to convert the second flow rate signal into a time averaged second signal having signal values proportionally variable in relation to specific time averaged sensed propulsion water flow rates.

5. The apparatus of claim 4, further comprising a display means to translate the time averaged second signals to a visual display.

6. The apparatus of claim 5, wherein the display means is an electronic digital visual display device and is equipped with a processing display driver means.

7. The apparatus of claim 5, wherein the visual display means is a combined visual display device for the water jet propulsion system and additional pumping systems present on a water craft, and is equipped with a processing display driver means.

8. The apparatus of claim 3, wherein the processing means further comprises:

a) a low voltage regulator means for supplying constant low voltage;

b) a clock means for providing base timing for rate averaging over time;

c) a scale conversion means for changing the second flow rate signal to a different signal scale with a control program stored in the memory of the processing means; and d) a precision voltage reference means to accurately maintain a desired time averaged voltage independent of any voltage regulator variation.

* * * * *